US005883569A

United States Patent [19]

Kolefas

[11] Patent Number: 5,883,569

[45] Date of Patent: Mar. 16, 1999

[54] IMPACT-RESPONSIVE SIGNAL TRANSMITTING DEVICE

[76] Inventor: Chris Kolefas, 1017 Edgewood La., Fort Lee, N.J. 07024

[21] Appl. No.: 571,259

[22] Filed: Dec. 12, 1995

[51] Int. Cl.[6] ..... G08B 3/00

[52] U.S. Cl. ..... 340/384.1; 340/384.3; 340/384.7; 340/385.1; 340/539; 273/372; 273/374; 446/400; 446/401; 446/405

[58] Field of Search ..... 340/384.1, 384.3, 340/384.5, 384.7, 385.1, 539, 825.69, 825.72, 326, 691, 436, 426, 323 R; 446/409, 397, 399, 400, 401, 404, 405; 273/371, 372, 373, 374, 377

[56] References Cited

U.S. PATENT DOCUMENTS

| | | | |
|---|---|---|---|
| 4,014,546 | 3/1977 | Steincamp | 273/374 |
| 4,461,117 | 7/1984 | Grott | 446/473 |
| 4,571,680 | 2/1986 | Wu | 364/410 |
| 4,722,282 | 2/1988 | Synofzik | 102/513 |
| 4,807,887 | 2/1989 | DeVale et al. | 273/372 |
| 4,847,589 | 7/1989 | Dobbins | 340/326 |
| 4,950,915 | 8/1990 | Spies et al. | 307/10.1 |
| 5,500,635 | 3/1996 | Mott | 340/323 R |
| 5,553,860 | 9/1996 | Zelikovich | 273/371 |

*Primary Examiner*—Jeffery A. Hofsass
*Assistant Examiner*—Julie Liew

[57] ABSTRACT

A mobile object with circuitry which transmits a signal upon impact of the object. The signal is received by a receiver which generates a sound in accordance with the signal. The occurrence of an impact can be detected by the contacting of conductive layers caused by the temporary deformation of the object or acoustically.

6 Claims, 9 Drawing Sheets

IMPACT-RESPONSIVE SIGNAL TRANSMITTING DEVICE

TECHNICAL FIELD

The present invention relates to devices which generate signals upon impact. More specifically, the present invention relates to a mobile object which transmits one or more sounds upon the occurrence of impacts involving the object.

SUMMARY OF THE INVENTION

The present invention is directed to a mobile object, for instance a projectile, which transmits a signal, such as a signal representative of a sound, to a receiving device upon the occurrence of certain events affecting the object.

One embodiment of an object in accordance with the present invention is in the form of what outwardly appears to be a rubber ball which can be thrown and which bounces upon impact. Within the ball, however, is an electronic circuit with a radio transmitter, which can optionally transmit, typically to a common AM- or FM-band radio receiver, a modulated audio signal simulating the sound of a projectile in motion, e.g., such as an incoming missile, bomb, boulder, meteor, etc. Upon impact with the ground or other hard surface, a second signal is transmitted from the ball simulating, for example, the sound of a bomb exploding or a large boulder or meteor landing. A variety of sounds can be selected by the user or preselected by design.

The device of the present invention comprises means for detecting impact and/or motion, sound generator means responsive to the detecting means for generating a simulated sound, and an RF transmitter for RF modulating and transmitting the simulated sound from an attached antenna to an RF receiver.

In another embodiment of the present invention, impact is detected by means of a microphone. In this embodiment, either the actual sound of impact picked-up by the microphone, or a synthetic generated sound, can be transmitted.

Yet another embodiment of the present invention takes the form of a shoe operating on the same principle. Whenever an impact of the sole occurs with the ground, circuitry in the shoe transmits an RF signal causing a sound to be heard from a nearby radio receiver.

Further variations are possible. For example, in conjunction with the generation of a sound upon impact, a light mounted on or in the object can be temporarily lit. In another embodiment, the circuitry in the moving object generates one or more binary signals to a specialized RF receiver which comprises a sound generator, amplification circuitry, a speaker, and optionally, a visual indication means.

DETAILED DESCRIPTION

Figure 1:
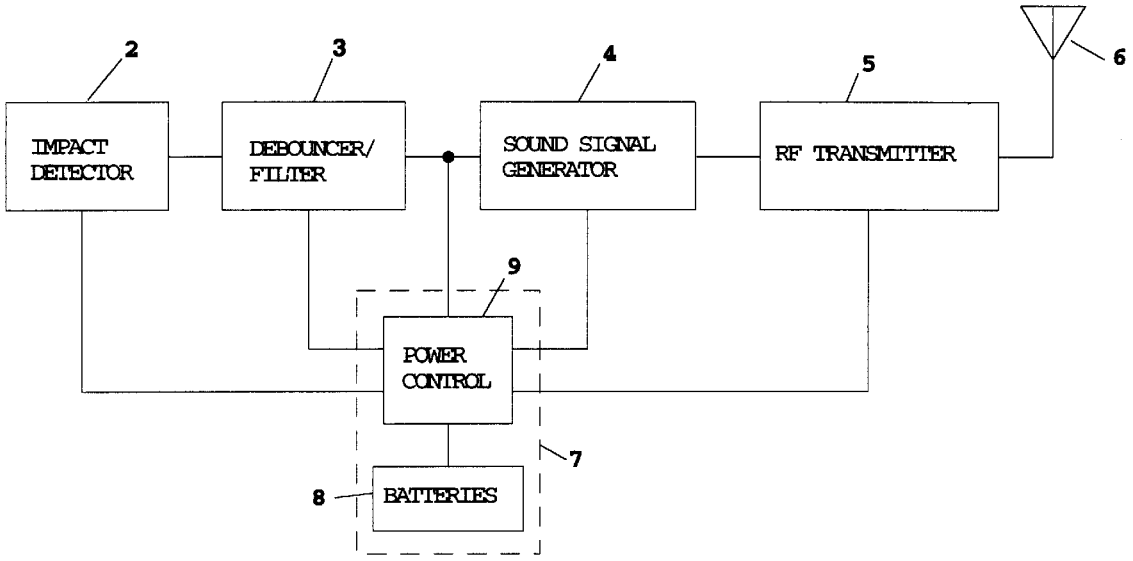
FIG. 1 is a block diagram of an exemplary embodiment of a circuit in accordance with the present invention.

FIG. 1 is a block diagram of a first embodiment of a circuit for use in an object in accordance with the present invention. The circuit typically resides within a projectile or ball such as that depicted in FIG. 2 (discussed below). The circuit comprises an impact detector 2, a debouncer or filter 3, a sound signal generator 4, an RF transmitter 5 with an antenna 6, and a power supply 7.

The impact detector 2 generates some electrical indication, either the conduction of current, as in the touching of contacts, or a change in capacitance, or the generation of a signal, upon impact of the projectile such as with a stationary object or hard surface. Several embodiments of an impact detector in accordance with the present invention are described below. The impact detector 2 is coupled to an input of the debouncer/filter 3. It is common for the signal generated by the impact detector 2 to have spikes and interruptions during the course of an impact. The debouncer/filter 3 generates a steady, uninterrupted, signal of a predetermined logic state to indicate the occurrence of an impact, as detected by the impact detector 2.

The signal generated by the debouncer/filter 3 is coupled to a trigger input of the sound signal generator 4. The debounced impact detection signal triggers the sound generator 4 to generate a preselected sound. A commercially-available sound generation integrated circuit, such as the YMU277, available from Yamaha Systems Technology of San Jose, Calif., can be used to implement the sound signal generator 4. The sound signal generator 4 can be preprogrammed to generate one sound or can generate a variety of sounds selectable by the user. Circuitry for allowing a user to select various sounds is described below The signal generated by the sound generator 4 is coupled to the RF transmitter 5 where it is modulated and transmitted from the antenna 6. The RF transmitter 5 can be implemented in a known manner and preferably transmits at an AM or FM band carrier frequency so that the RF signal transmitted can be received by a conventional, commercially-available radio receiver. The power of transmission must of course be within limits set by the FCC and the carrier frequency should be such as to minimize the possibility of interference.

The power supply 7 provides regulated DC voltage for powering the components of the circuit assembly. The power supply 7 comprises one or more batteries 8 and a power control sub-circuit 9. The power control sub-circuit 9 has an input that is coupled to the output of the debouncer/filter 3 and which is used to monitor impact activity. The power control sub-circuit 9, impact detector 2 and debouncer/filter 3 are always powered. If no signal is generated by the debouncer 3 during a period longer than some predetermined time (e.g., 2 minutes), power to the sound generator 4 and RF transmitter 5 is turned off to conserve battery life. Once a signal is detected, power is provided to the sound generator 4 and RF transmitter 5. This feature is particularly advantageous where access to the circuit assembly and batteries is limited. In an alternative embodiment, an ON/OFF switch accessible by the user can be provided to control power to the entire circuit.

Figure 2:
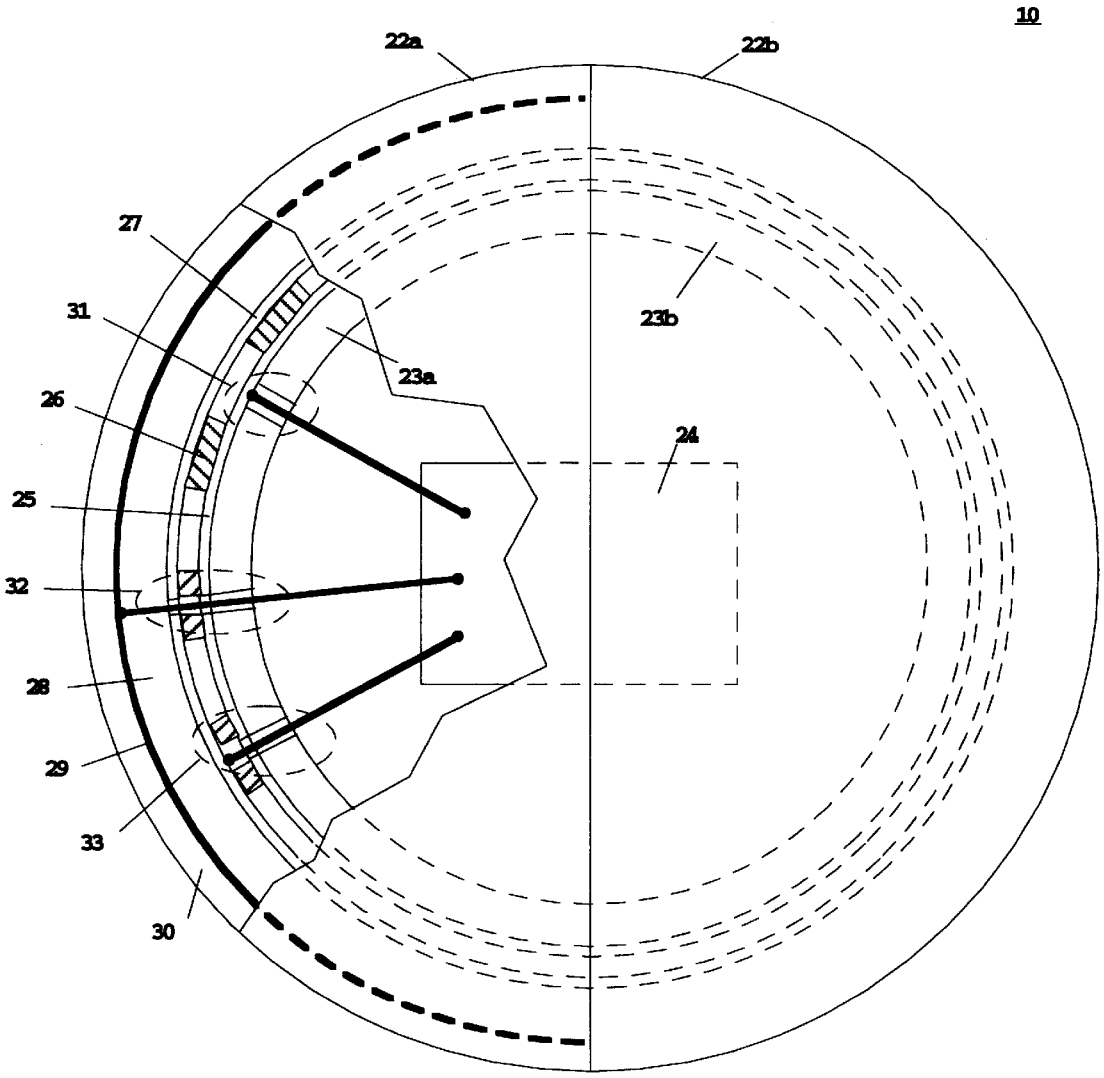
FIG. 2 is a cross-sectional view of an exemplary embodiment of a ball device in accordance with the present invention.

FIG. 2 is a cross-sectional view depicting the physical configuration of an embodiment of a projectile 10 in accordance with the present invention. For predictable bounce characteristics, the projectile 10 is preferably in the shape of a sphere, as shown, but need not be. For example, the projectile 10 can have an ellipsoid, or football-like shape or any other shape convenient for a given application.

As described in greater detail below, the embodiment of FIG. 2 has impact detection means built into the body of the projectile which impact detection means senses deformation of the outer shape of the projectile 1, as occurs upon impact.

As shown in FIG. 2, the projectile 10 is preferably comprised of two hemi-spherical halves, 22*a* and 22*b*, which are detachably joined circumferentially. Each hemisphere 22*a* and 22*b* comprises a respective inner, hemispherical shell, 23*a* and 23*b*. The hemispherical shells 23*a* and 23*b* form an inner space for housing a circuit assembly 24 which comprises a circuit such as that described above. Means (not shown for clarity) are provided within the inner space for securing the circuit assembly 24. The hemispherical shells 23*a* and 23*b* are preferably formed of a rigid, lightweight material which will not deform appreciably upon impact of the projectile 10 and which can suitably protect the circuit assembly 24 from damage.

An electrically conductive layer 25 is attached on the outer surface of each hemisphere 23*a* and 23*b*. (Although referred to as one conductive surface, for convenience, the conductive layer 25 is formed as two hemispherical parts covering each hemispherical shell 23*a* and 23*b*.) The conductive surface 25 is in electrical contact with the circuit assembly 24 through openings 31 in the hemispherical shells 23*a* and 23*b*. Another hemispherical conductive layer 27, is provided radially outward of the conductive layer 25 and separated therefrom by a non-conductive spacer layer 26. Layer 27 preferably comprises a deformable, resilient, material allowing the layer to be deformed temporarily. Layer 26 is provided with a plurality of openings allowing electrical contact between layers 27 and 25 upon deformation of layer 27, but otherwise electrically isolating the two conductive layers. The conductive surface 27 is in electrical contact with the circuit assembly 24 through one or more wires passing through one or more openings 33 in the spacer layer 26, conductive layer 25, and hemispherical shells 23*a* and 23*b*.

A layer 28 of resilient, deformable material, such as rubber, encapsulates the conductive layer 27. A third conductive layer 29, is situated on the outer surface of the resilient layer 28, and is in electrical contact with the circuit assembly 24 through openings 32 in the layers 28, 27, 26, and 25, and hemispherical shells 23*a* and 23*b*. Layer 29, like layer 27, preferably comprises a resilient, deformable material. Layer 29 operates as the antenna 6, described above, which is used to transmit RF signals. Finally, an outer layer 30, of a resilient, deformable material, is situated on the outer surface of conductive layer 29 and encapsulates the assembly comprising layers 29, 28, 27, 26, and 25, and shell 23. The layers 28 and 30 can also be formed as one layer with the antenna layer 29 impregnated therein. Moreover, the antenna 29 can be implemented as a wire, as opposed to a layer.

Upon impact, temporary deformation of the outer profile of the projectile 10 occurs which causes the conductive layer 27 to come into electrical contact with the conductive layer 25, thus allowing current to flow from one layer to the other. This flow of current is then used to activate the circuit, described above, which is implemented on the circuit assembly 24.

It should be noted that several variations in the implementation of the above embodiment are possible. For example, the primary purpose for implementing the projectile 10 as two hemispherical sub-assemblies is to allow access to the circuit assembly 24 for the purposes of, for instance, replacing batteries or for access to switches for controlling circuit operation. If such access is not required, the projectile can be simplified, for example, by permanently encapsulating the circuit assembly 24 within permanently joined hemispherical parts.

Furthermore, the conductive layers 25, 27, and 29 may be formed of a mylar material with conductive ink thereon. In order to save on the cost of conductive ink, these layers need not be solid hemispherical layers, but could rather have perforations or simply contact targets spaced throughout the spherical surface area of the projectile. Moreover, at least some of the layers can be implemented with wires, such as a wire mesh, or strips of conductive material.

In another advantageous embodiment, the one or both of each of the conductive layers 25 and 27 can be segmented into sections that are electrically isolated from each other; e.g., the hemispherical section 25*a* can be electrically isolated from the hemispherical section 25*b*. Each section can thereby be part of a separate impact detector for detecting an impact involving the corresponding section of the projectile. As such, the circuit of FIG. 1 can be modified to provide a different sound as a function of the section of the projectile that was impacted. Thus for example, a first sound can be generated when the hemispherical layer section 25*a* contacts the layer 27 and a second sound when the hemispherical layer section 25*b* contacts the layer 27. Of course, the layers 25 and/or 27 can be subdivided further for generating further sound variations.

The circuit of FIG. 1 can also be modified to provide a different sound every time any impact is detected. For instance, logic controlling which one of several selectable sounds the sound generator 4 generates can include counter means which is incremented whenever an impact is detected, with the contents of the counter means used to select the sound which the sound generator 4 is to currently generate.

Figure 3:
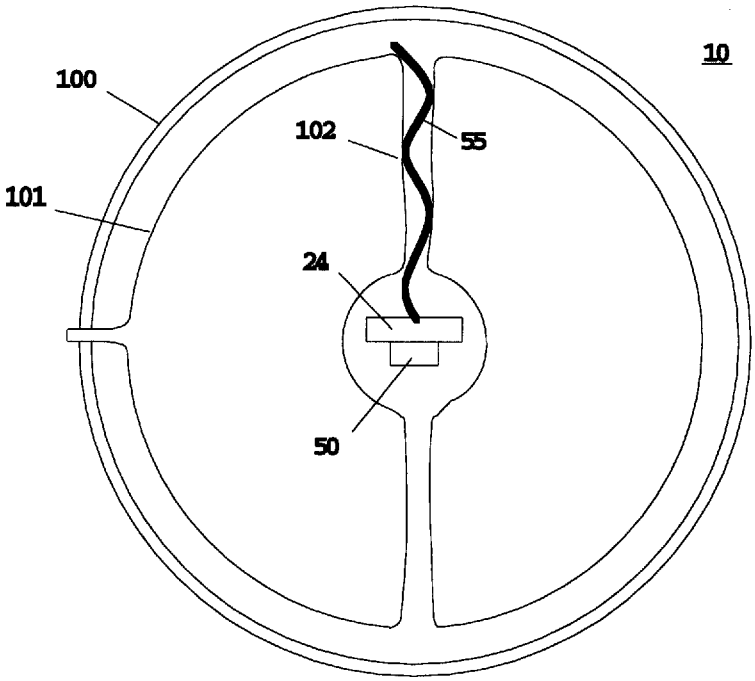
FIGS. 3, 3*a* and 3*b* are cross-sectional views of further exemplary embodiments of a ball device in accordance with the present invention.
Figure 4:
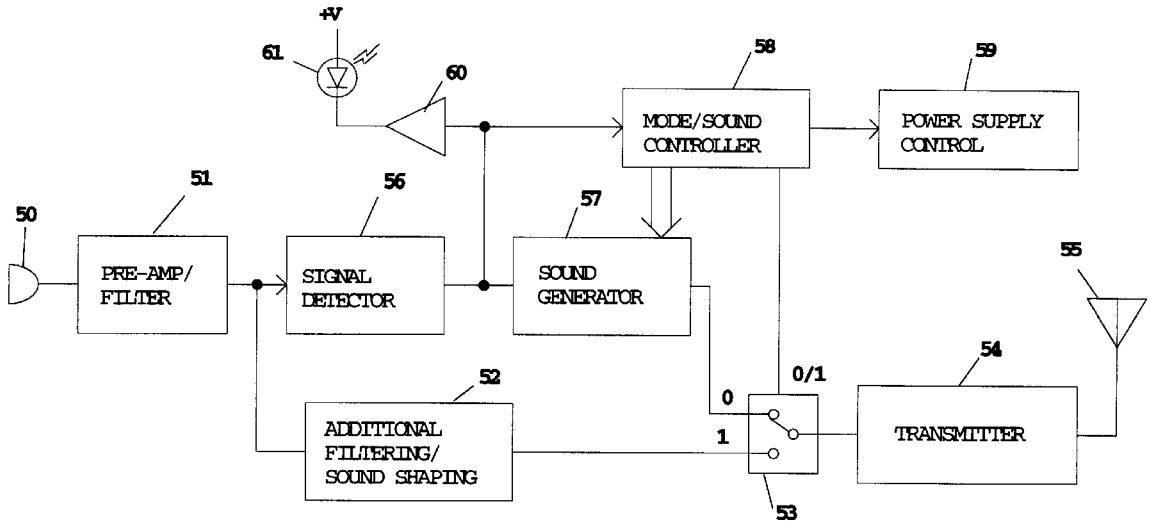
FIGS. 4, 4*a*, 4*b*, 4*c* and 4*d* are diagrams of further exemplary embodiments of a circuit in accordance with the present invention.

FIG. 3 shows the physical configuration of another embodiment of a ball 10 in accordance with the present invention. (Like reference numerals indicate like components in the previously described embodiment.) In this embodiment, impact detection is achieved acoustically. The corresponding circuitry for this embodiment is shown in FIG. 4 and is described in greater detail further below.

Figure 3A:
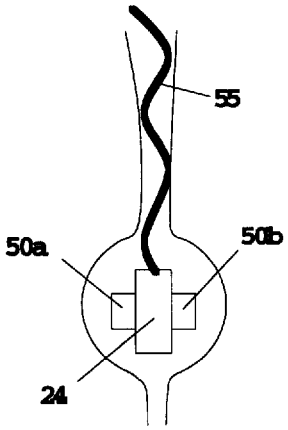

In the embodiment of FIG. 3, the circuit assembly 24 comprises a microphone 50, (or two microphones 50*a* and 50*b*, as shown in FIG. 3*a*) which provides an electrical signal representative of any sounds detected thereby. For optimally uniform coverage, the microphone 50 should preferably be situated in the center of the projectile 1, although other locations can provide satisfactory results. Moreover, to simplify the construction of the circuit assembly 24 and the overall assembly of the projectile 1, the microphone should preferably be situated as part of the circuit assembly 24.

In the embodiment of FIG. 3, the projectile 10 is an air-filled sphere, such as a basketball, having an outer cover 100 enclosing an air-filled inner bladder 101, a s is the case with many conventional balls. The bladder 101 is provided with a tubular passage 102, extending from a first point on the surface of the bladder, generally through the center of the ball, on through to a second point on the surface of the bladder 101, opposite from the first point. The circuit assembly 24 is placed in the center of the tubular passage 102, which corresponds generally with the center of the ball 1. The tubular passage 102, like the rest of the bladder 101, is preferably comprised of a resilient material, such as rubber or any such similar material as is typically used for bladders, and stretches to accommodate and snugly hold the circuit assembly 24 within. The circuit assembly 24 can be further secured, for instance, with adhesive and/or by forming the passage 102 with notches or grooves to further prevent slippage of the assembly 24 within the passage. An antenna 55 can be attached to the circuit assembly 24 and strung along the tubular passage 102 and/or further extended along the area between the bladder 102 and the outer cover 100 to maximize signal radiation.

Figure 3B:
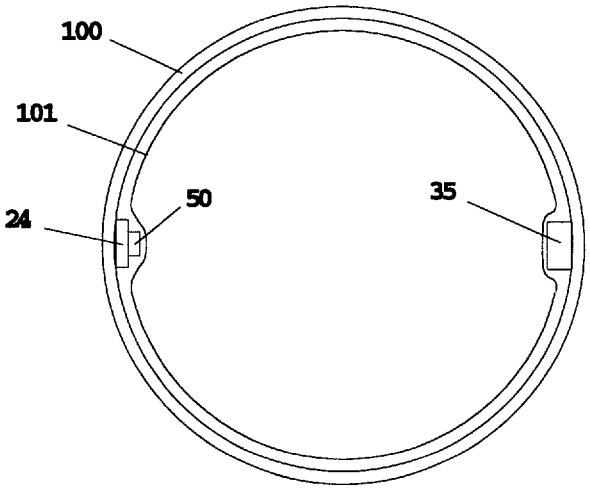

FIG. 3*b* shows yet another embodiment of the present invention in which the circuit assembly 24 is located on the inner wall of the outer cover 100, with the microphone facing inward. Preferably, a counterweight 35 is located on the inner wall of the outer cover 100 across from the circuit assembly if the ball is to be balanced. The ball 10 may or may not have an inner, air-filled bladder 101.

FIG. 4 shows an exemplary circuit to be implemented on the circuit assembly 24 using the microphone 50. In the circuit of FIG. 4, the microphone 50 can be used in one of two ways. In the first mode, the sound picked up by the microphone 50 is transmitted over an RF link to a radio receiver. In the second mode, the sound picked up by the microphone is processed to determine the occurrence of an impact condition and a signal indicative of the impact or a synthetic sound is generated and transmitted over an RF link to a radio receiver.

Figure 4D:
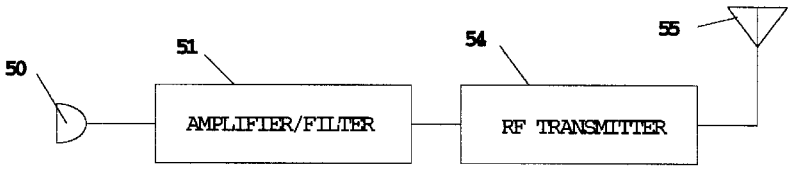
Figure 4A:
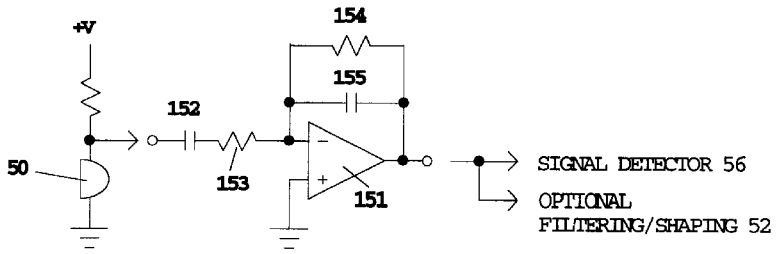

In the circuit of FIG. 4, the microphone 50 is coupled to an amplifier/filter stage 51 whose output is coupled to both a signal detector 56 (described further below) and an optional additional filtering/shaping stage 52. The amplifier/filter stage 51 amplifies any sound detected by the microphone 50 and provides filtering to eliminate unwanted noise. The optional stage 52 provides additional filtering and/or shaping to generate a satisfactory representation of the detected sound. For instance, if the sound detected by the microphone 50 upon an impact is too tinny, shaping providing a boost of the lower frequencies and an attenuation of higher frequency components could be implemented to provide a more resounding sound. The amplifier/filter stage 51 and additional filtering/shaping stage 52 can be implemented compactly and simply using a common op-amp integrated circuit, as shown in FIG. 4*a*. Op-amp integrated circuits with multiple op-amps on a single chip are preferable for minimizing the space requirements of the circuit.

The signal detector 56 detects the presence of a sound signal at the output of the microphone 50. If the level and/or duration of the detected signal exceeds predetermined threshold levels, the signal detector 56 generates a logic signal indicating the presence of a sound. The signal detector 56 can also be implemented using an integrated op-amp or comparator circuit (preferably on the same chip as the amplifier/filter stage 51 for compactness), such as shown in FIG. 4*b*.

Figure 4B:
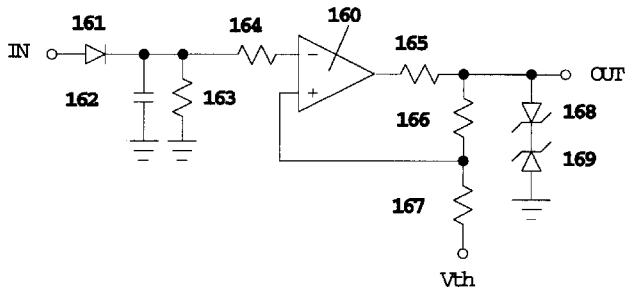

In the circuit of FIG. 4*b*, an op-amp 160, in conjunction with resistors 164–167 and diodes 168 and 169, is configured as a Schmitt trigger which triggers about a threshold voltage $V_{th}$ which is set to distinguish the signal level generated by the stage 51 when an impact occurs from that generated by unwanted noise. The circuit of FIG. 4*b* also preferably includes an envelope-detecting input sub-circuit comprising diode 161, capacitor 162 and resistor 163.

The output of the signal detector 56 is coupled to a sound generator 57, such as that described above with respect to FIG. 1. The sound generator is triggered by the output of the signal detector 56 to generate a preselected sound upon detection of an impact condition.

The output of the signal detector 56 can also be coupled to a driver 60, driving an LED 61, or other suitable light generating device, to light whenever the output of the signal detector 56 indicates the occurrence of an impact. Thus, in addition to an audible indication of impact, a visual indication is also provided. If the outer cover 100 and bladder 101 are made of a transparent, or translucent material, the LED 61 can advantageously be located on the circuit assembly 24, thus maintaining a compact, unitary circuit assembly.

The outputs of the sound generator 57 and of the filtering/shaping stage 52, are coupled to inputs of a mode selector 53. The mode selector 53, under the control of a mode/sound controller 58, directs either the output of the sound generator 57 or the output of the filtering/shaping stage 52 to a transmitter 54 coupled to the mode selector 53. The mode selector 53 can be implemented using an analog switch. The transmitter 54 is similar to the transmitter described above with respect to the circuit of FIG. 1 and generates an RF modulated signal for transmission from the antenna 55 coupled to its output.

The mode/sound controller 58 is coupled to the sound generator 57 and the mode selector 53 and is used to determine the desired mode of operation and to select the sound to be generated by the sound generator 57. The mode/sound controller 58 can also be coupled to a power supply control circuit 59 for controlling the power consumed by the circuit assembly The mode/sound controller 58 has an input coupled to the output of the signal detector 56. The mode/sound controller 58 updates the mode of operation and/or selected sound upon detecting a predetermined sequence of sounds which is selected so that the probability of its occurrence, under normal operating conditions, is very low. For example, if the user raps the projectile a preselected number of times (e.g., 5) within a preselected time period (e.g., 1.5 seconds), the mode/sound controller 58 will rotatably increment through a list of possible modes and/or sounds, such as the following: 0) low-power sleep mode (initial mode); 1) actual sound mode; 2) generated sound 1; . . . n) generated sound n−1.

Note that the mode/sound controller 58 can be used to control the power consumed by the circuit. For example, in the low power "sleep" mode, mode 0, the power supply provides power only to the pre-amp/filter stage 51, signal detector 56, and the mode/sound controller 58. The low-power sleep mode preserves battery life.

Figure 4C:
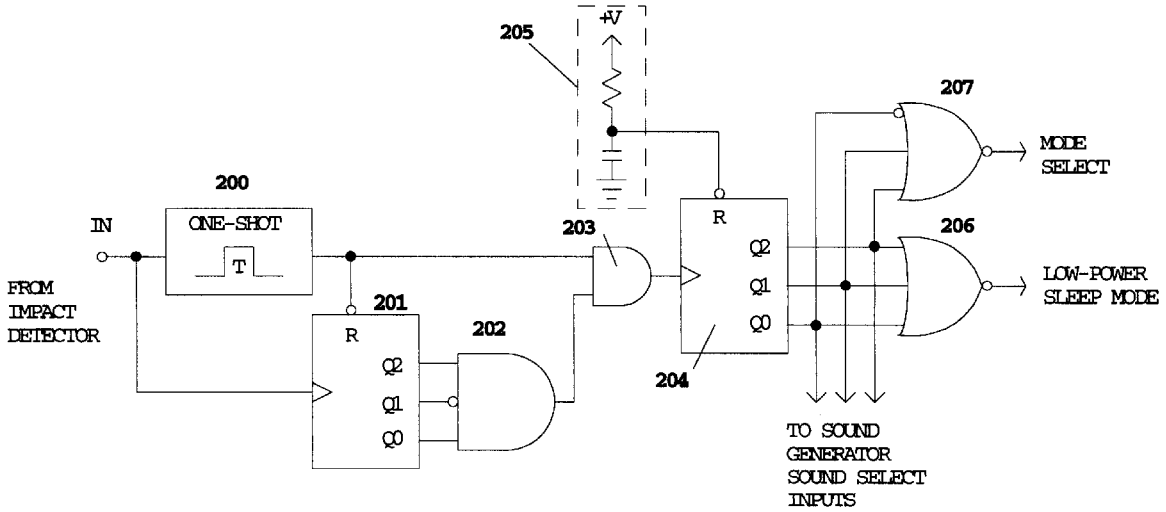

FIG. 4*c* shows a more detailed schematic of an embodiment of the mode/sound controller 58. In this implementation, a one-shot, or monostable vibrator 200, is triggered upon the rising edge of the input signal from the sound detector 56, to generate a pulse of duration T. As the input is repeatedly pulsed, as in the case of a user rapping the ball 10, a counter 201 is incremented accordingly. If the number of raps counted reaches 5 (in this example), as determined by gate 202, while the pulse generated by the one-shot 200 is still high, a high pulse is generated by gate 203. Each pulse generated by gate 203 increments a second counter 204 by one. Upon powering-up, reset sub-circuit 205 guarantees that the counter 204 will be reset to a count of 0 (i.e., Q2–Q0=000). Upon reset, gate 206 generates a high signal which is output to the power control circuit to specify that the power control circuit is to place the circuit into the low-power sleep mode. Upon a first increment, the counter 204 increments to a count of 1, causing a gate 207 to generate a high signal to the mode selector 53 so that it selects the "actual sound" mode in which the actual sound picked up by the microphone 50 is transmitted to the receiver. Subsequent increments of the counter 204 cause the sound generator to step through the various sounds it is capable of generating.

It is also possible to implement the mode/sound controller to respond to different preselected sound patterns. For example, the mode/sound controller 58 can be implemented to respond to a first sub-pattern of sounds followed by a number of raps indicating the desired mode/sound. This implementation would allow the user to proceed directly to the desired mode/sound without having to sequence through the other modes/sounds until the desired mode is found. Note, that the mode/sound controller can also be implemented in the other described embodiments. For example, in the embodiment of FIGS. 1 and 2, the mode/sound controller can use the output of the impact detector instead of the signal detector.

Note also, that the low-power sleep mode can also be entered using a timer, without the intervention of the user. For example, if no signals have been detected by the sound detector within N intervals, as counted by a third counter incremented by a stable timer/oscillator, the low-power sleep mode signal is set high, indicating to the power control circuit to change to low-power mode.

It should also be readily apparent that simpler versions of the circuit of FIG. 4 can also be implemented, such as in the case in which only the actual sound detected by the microphone 50 is transmitted. Such a simplified circuit is shown in FIG. 4*d* which includes the microphone 50, the amplifier/filter stage 51, the RF transmitter 54 and the antenna 55. In this case, the amplifier/filter stage 51 may also incorporate the functionality of the additional filtering block 52 in the circuit of FIG. 4.

Figure 5:
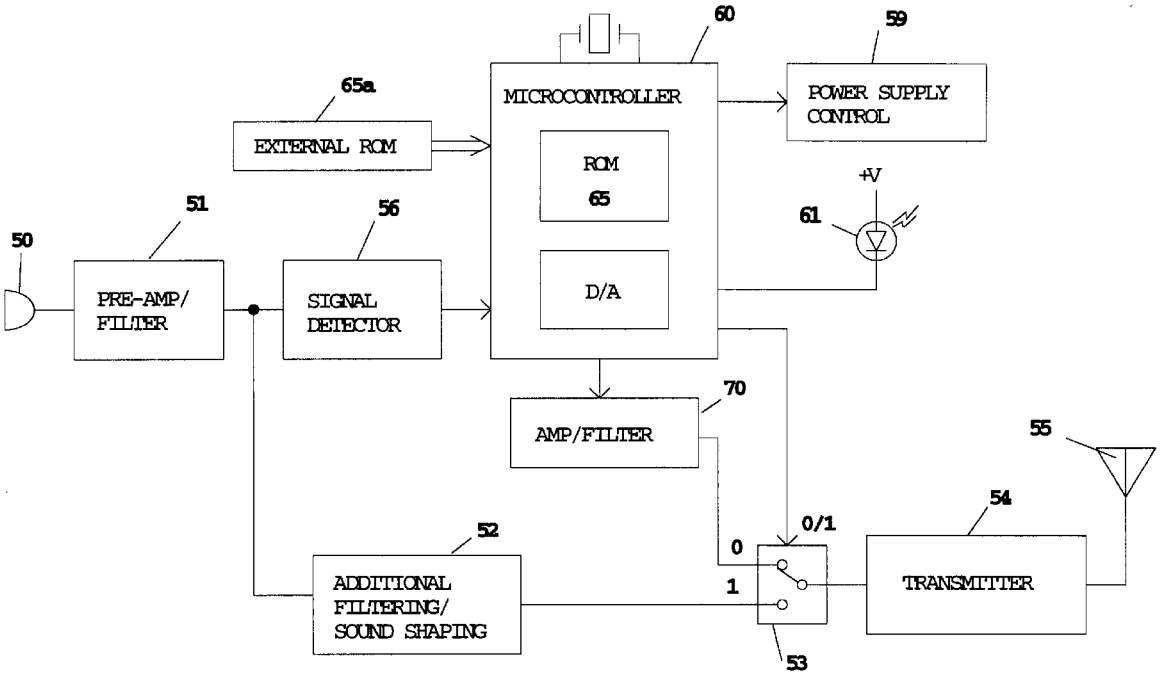
FIG. 5 is a block diagram of an embodiment of a circuit in accordance with the present invention.

Note that the circuit of FIG. 4 can also be advantageously implemented using a microcomputer 60, as shown in FIG. 5. A commercially-available microcomputer, such as the single-chip TMP90C846F microcomputer available from Toshiba America Electronic Components, Inc. of Irvine, Calif., which integrates a microprocessor, memory, I/O, an oscillator and a D/A converter, can be used for such an embodiment. In the circuit of FIG. 5, the microcomputer 60 replaces the sound generator 57 and mode/sound controller 58. Sound signals are generated by an on-chip digital-to-analog converter (D/A) 61 from digital representations of one or more sounds stored in an on-chip read-only memory (ROM) 65 and/or an external ROM 65*a*. The ROM can be either: 1) entirely on-chip (65), 2) entirely off-chip (65*a*), or 3) partly on-chip (65) and partly off-chip (65*a*). The off-chip ROM 65*a* can advantageously be packaged in a changeable cartridge which the user can purchase and insert onto the circuit assembly 24 thus allowing for a limitless library of sounds and/or features. In the alternative, all ROM can be on-chip (65) and the entire microcomputer 60 can be packaged as a changeable cartridge.

An optional signal amplifier/filter 70 has an input which is coupled to the output of the D/A 61. The amplifier/filter 70 has an output which is coupled to one of the inputs of the mode selector 53. The mode selector 53 is controlled directly from an I/O port of the microcomputer 60.

It should also be noted that a simpler variant of the circuit of FIG. 5 can be implemented which does not include the D/A 61 as in the case in which a simpler array of sounds can be tolerated. In this case, the microcomputer would be programmed to generate sounds by repeatedly toggling high and low (i.e., "bit-banging") one or more of its I/O ports. This would generate a rectangular pulse train which would preferably be filtered and/or amplified or attenuated by the sub-circuit 70. Different sounds can thereby be generated by varying the toggling pattern and/or frequency of toggling under the direct control of the microcomputer 60.

Using a microcomputer, as in the circuit of FIG. 5, allows for flexibility in circuit implementation and operation and allows implementation of all of the above-described features and more. For example, the microcomputer can be programmed to vary the generated sound every time an impact is detected. A microcomputer can also be advantageously used in the circuits of FIGS. 1 and 6 (described below).

Figure 6:
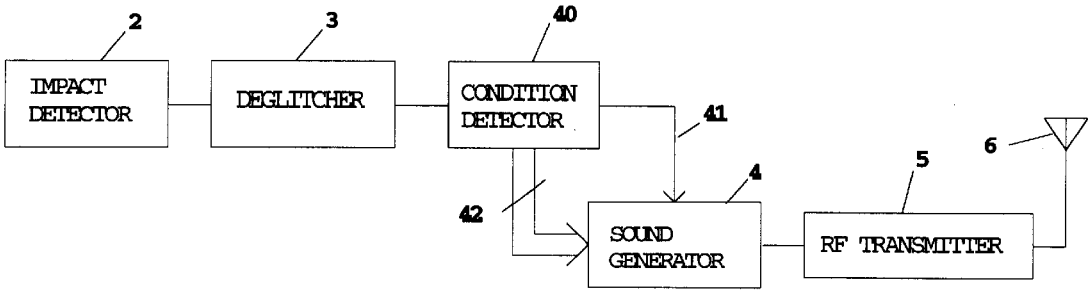
FIG. 6 is a block diagram of an embodiment of a circuit in accordance with the present invention.

FIG. 6 shows another embodiment of a circuit that can be used in conjunction with the physical embodiment of FIG. 2 (or with that of FIG. 3, by substituting the impact detector 2 and deglitcher 3 with the pre-amp/filter stage 51 and signal detector 56 of the circuit of FIG. 4.) This circuit provides the added feature of generating a first sound simulating the sound made by the projectile in motion. Upon impact, the first sound, which simulates motion, stops and a second sound, simulating impact, is then generated. The first sound, for example, can be the whistling sound of an incoming missile, and the second sound can be that of an explosion.

In the circuit of FIG. 6, a condition detector 40 is inserted between the deglitcher 3 and the sound generator 4. The condition detector 40 monitors the output of the deglitcher 3, which is a filtered representation of the output of the impact detector 2.

In an exemplary embodiment, if the output of the deglitcher 3 is at the logic level indicative of an impact for longer than some predetermined time interval—as in the case where the user is squeezing the projectile 10 thereby deforming its surface and causing the contacts of the impact detector 2 to come into contact—the condition detector 40 causes the sound generator 4 to generate a first sound, typically simulative of motion. Note that the time interval (e.g., 3 sec.) should be substantially longer than the duration of an impact. Upon occurrence of an impact, the condition detector 40 causes the sound signal generator 4 to generate a second sound, typically simulative of an impact.

The condition detector 40 controls the sound generator 4 by two sets of signals. The first set of signals comprises an enable signal 41. The sound generator 4 will steadily generate a signal for as long as the enable signal is at a first predetermined logic level (e.g. LOW). The second set of signals 42, comprises a bus of signals which specify which one of several different sounds the sound generator 4 is to generate. The condition detector 40 will cause the sound generator 4 to generate the first sound, preferably continuously, until an impact is detected. Upon impact, the deglitcher 3 will generate a pulse which will be substantially shorter in duration than the first predetermined time interval (e.g., 3 sec.). Upon detection of such a pulse, the condition detector 40, will cause the sound generator 4 to generate the second sound simulating impact.

It should be readily apparent from the above description that the condition detector 40 can be modified to allow for other procedures to cause the sound signal generator 4 to generate the first sound. For example, where the circuit of FIG. 6 is adapted for use in a physical configuration such as that of FIG. 3, the condition detector can cause the generator 4 to generate the first sound upon the detection of a predetermined number of impacts (e.g., 5) within a predetermined time period (e.g., 1.5 seconds), as when the user raps the ball in rapid succession.

Figure 7:
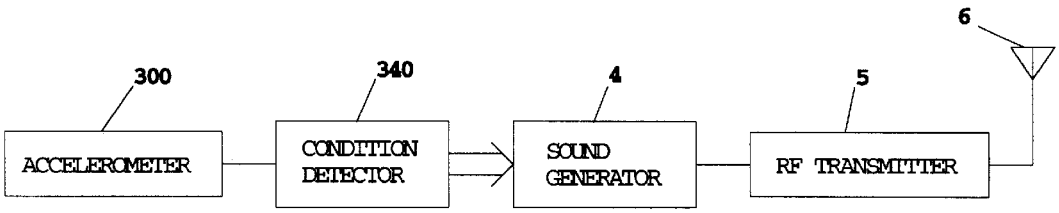
FIG. 7 is a block diagram of an embodiment of a circuit in accordance with the present invention.

FIG. 7 shows another embodiment of a circuit with the feature of generating a sound while the projectile is in motion. The circuit of FIG. 7 includes an accelerometer 300, which is preferably located at the center of the projectile 10. A commercially-available accelerometer, as is typically used in automotive applications, can be used as the accelerometer 300. The signal output of the accelerometer is analyzed by a condition detector 340 which determines whether the projectile 10 is experiencing an impact condition. The condition detector 340 controls the sound generator 4 accordingly to generate a sound upon a detected impact. The circuit of FIG. 7 can be used in a hollow, air-filled projectile, such as that of FIG. 3, or in a solid rubber-clad projectile, such as that of FIG. 2. Note that the use of an accelerometer simplifies the physical configuration and makes for a contained assembly.

In addition to detecting an impact, the condition detector 340 of the circuit of FIG. 7 can also be designed to analyze the signal from the accelerometer 300 to determine whether the projectile is experiencing other degrees of acceleration. For example, when the projectile 10 is thrown, the accelerometer 300 will detect a level of acceleration clearly exceeding that at a stationary condition but clearly less than that during an impact condition. While a signal indicative of such a level of acceleration is detected, the condition detector 340 controls the sound generator 4, as described above in connection with FIG. 6, to generate a first sound, such as a sound representative of motion. Upon detection of a signal indicative of the level of acceleration during an impact, the condition detector 340 controls the sound generator 4, as described above in connection with FIG. 6, to generate a second sound, such as a sound representative of a collision or explosion.

Figure 8:
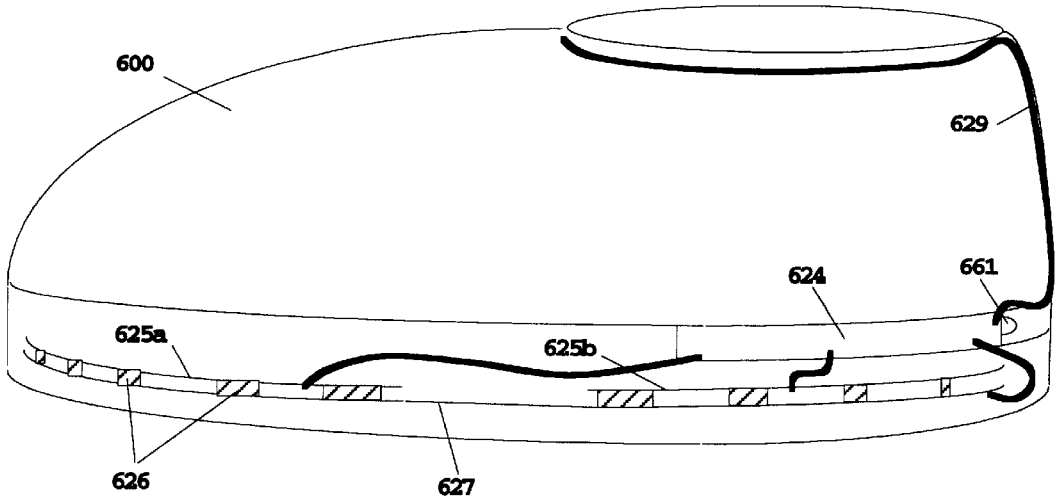
FIGS. 8, 8*a* and 8*b* are cross-sectional views of further embodiments of a device in accordance with the present invention.

FIG. 8 shows yet another physical embodiment of the present invention adapted, for instance, to footwear. In this embodiment, the impact detector structure described with respect to FIG. 2, is adapted for application in a shoe 600.

In the exemplary embodiment of FIG. 8, a first conductive layer 627 distributed in the sole of the shoe 600 is separated from one or more conductive layer sections 625*a*, 625*b* by an insulating spacer layer 626. When the wearer steps down, the conductive layer 627 makes electrical contact with at least one of the conductive layer sections 625*a*, 625*b*. In the exemplary embodiment of FIG. 8, when the wearer steps down with the front of the shoe, contact is made between the layer 627 and the layer section 625*a*. In response, the circuit assembly 624 generates and transmits an RF modulated signal representative of a first sound. When the wearer steps down with the heel of the shoe, contact is made between the layer 627 and the layer section 625*b*. In response, the circuit assembly 624 generates and transmits an RF modulated signal representative of a second sound. Of course, in a simpler implementation, the layer sections 625*a* and 625*b* can be joined physically and/or electrically.

The circuit assembly 624 is placed in the sole and is preferably accessible from above from the foot-containing compartment of the shoe 600 to allow for programming and/or battery changes. In addition, the circuit assembly may also include an LED 661, visible from the exterior of the shoe, for emitting a light upon impact of the shoe with the ground. An antenna wire or layer 629, can optionally be connected to the circuit assembly 624, and arranged along the inside of the shoe, as shown in FIG. 8 so as to maximize the signal radiated therefrom.

Figure 8A:
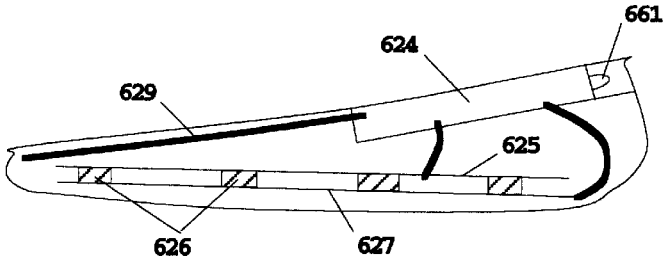

In addition to being integrated into a complete shoe, the device of the present invention can be integrated into a separate sole or part of a sole, such as a heel, as shown in FIG. 8*a*, that can be attached to the bottom of a conventional shoe. In this case, the antenna 629 can be arranged along the top of the heel or implemented as a conductive layer and applied to the top of the heel to maximize signal radiation.

Figure 8B:
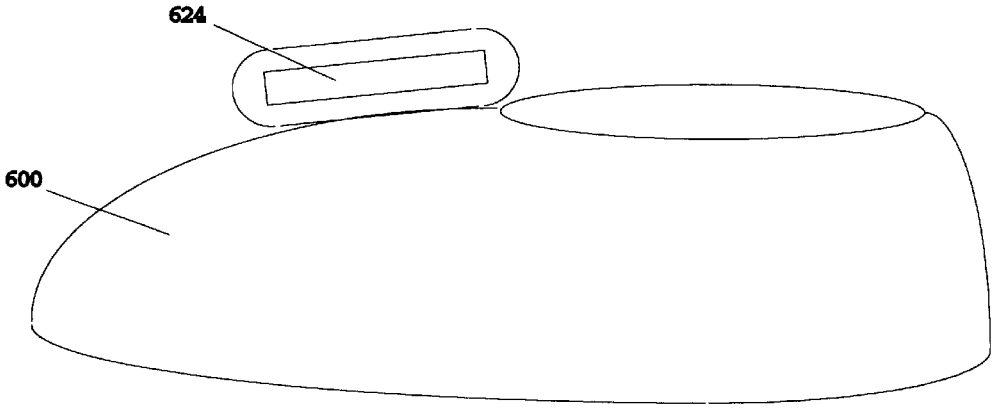

It should be evident that the shoe embodiment of FIG. 8, can be modified to operate with an accelerometer, such as described with respect to FIG. 7. As above, such a variant has the advantage of a simple physical configuration and a contained assembly. In this case, the circuit assembly 624 can be contained in a package that can be placed almost anywhere such as above the shoe, attached to the shoelaces, as shown in FIG. 8*b*, or even carried in a pocket of an article of clothing.

Figure 9A:
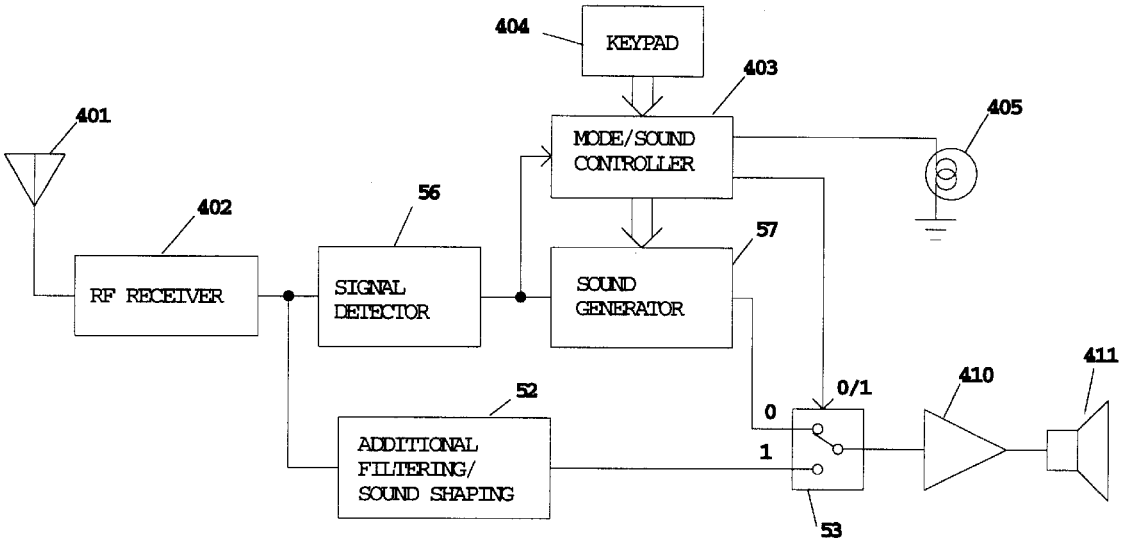
FIGS. 9*a* and 9*b* are block diagrams of a receiver and transmitter, respectively, in accordance with the present invention.

Each of the above-described circuit embodiments can be modified to operate in conjunction with a specialized RF receiver. FIG. 9*a* shows a specialized receiving circuit for use in conjunction with a modified version of the circuit of FIG. 1, shown in FIG. 9*b*, or with the circuit of FIG. 4*d*.

As can be seen from a comparison with the circuit of FIG. 4, the circuit of FIG. 9*a* includes much of the same circuitry. However, by locating such circuitry in the receiving circuit, the transmitting circuit can be simplified considerably, such as the circuit of FIG. 4*d*. In the case of the receiving circuit of FIG. 9*a*, however, because space requirements are typically not as confined as they are with the transmitting circuit, a keypad 404 can be included for controlling the operating mode and sound selection of the circuit. The circuit of FIG. 9*a* further includes an RF receiver 402, an amplifier stage 410 and a speaker 411. The circuit of FIG. 9*a*, like that of FIG. 4, can also include a visual display device, in this case a lamp 405.

Figure 9B:
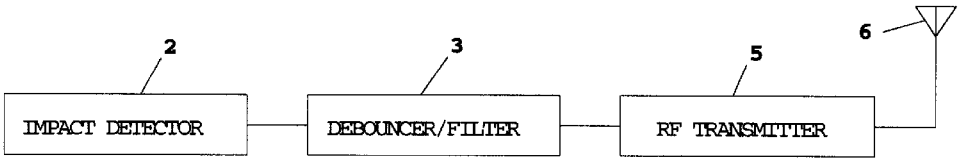

FIG. 9*b* shows an embodiment of a transmitting circuit which detects the occurrence of an impact and transmits an RF-modulated logic signal indicative of the impact. The transmitted signal is received by a receiving circuit, such as that of FIG. 9*a*. It should be evident, however, that if the receiving circuit of FIG. 9*a* is to be used only in conjunction with the transmitting circuit of FIG. 9*b*, the signal detector 56, filtering/shaping block 52, selector 53 and associated selection control can be eliminated, thereby simplifying the circuit of FIG. 9*a*.

Although the embodiment of FIG. 9*b* requires a specialized receiver, it has several advantages. First, it is less susceptible to interference over the RF link since only a binary indication of an impact is transmitted as opposed to an analog representation of the sound signal itself. Second, the circuit in the projectile is significantly simplified since it need only transmit an impact indication, without generating the actual sound signal itself and without having to provide for user input. Sound and/or mode selection can be done at the receiver directly with user-accessible switches. Third, the specialized receiver can be provided with enhanced features not available on generic AM- or FM-band receivers, such as visual indication of impact.

Moreover, for all the above-described embodiments, to reduce the possibility of RF interference from several projectiles, projectiles can be produced to transmit at one of N different frequencies, where N is factory-set or user selectable.

For at least some the above-described embodiments, instead of an RF transmission link, other communication links can advantageously be used in the alternative, such as an IR link. In such an embodiment, an IR transmitter can be used instead of an RF transmitter and the receiver comprises an IR photo-detector. Such an embodiment is best suited where there is an unobstructed line-of-sight between the transmitter and the receiver.

What is claimed:

1. A mobile object comprising:

a body in the shape of a ball;

an impact detector arranged in the body for detecting an impact involving the object and generating a first signal in response to the detection of the impact;

a signal generator coupled to the impact detector, the signal generator including a sound signal generator for generating a sound signal representing a sound in response to the first signal; and a transmitter for transmitting the sound signal for reception by a receiving device responsive to the sound signal, wherein the body of the object has an inner cavity and the impact detector includes:

a microphone, the microphone being arranged within the inner cavity of the body and generating a signal representative of sounds detected by the microphone; and a signal analyzer coupled to the microphone, wherein the signal analyzer generates the first signal upon determining that the signal generated by the microphone is representative of an impact involving the object.

2. A mobile object comprising:

a body in the shape of a ball;

an impact detector arranged in the body for detecting an impact involving the object and generating a first signal in response to the detection of the impact;

a signal generator coupled to the impact detector, the signal generator including a sound signal generator for generating a sound signal representing a sound in response to the first signal; and a transmitter for transmitting the sound signal for reception by a receiving device responsive to the sound signal, wherein the signal generator generates an initial sound signal representing an initial sound before the first signal is generated.

3. An impact responsive device comprising:

a mobile object comprising:

a body with an inner cavity; and a circuit assembly mounted in the inner cavity of the body, the circuit assembly including:

a microphone for generating a sound signal representative of actual sounds detected by the microphone;

signal conditioning circuitry coupled to the microphone for conditioning the actual sound signal; and a transmitter coupled to the signal conditioning circuitry for transmitting the conditioned actual sound signal for reception by a receiving device.

4. An impact detection system comprising:

a mobile object including an impact detector for generating a signal indicative of an impact involving the object, and a transmitter for transmitting the signal indicative of the detected impact; and a base station including a receiver for receiving the signal indicative of the detected impact, a sound signal generator for generating a sound signal pattern in response to the received impact signal, an amplifier coupled to an output of the sound signal generator and a speaker coupled to an output of the amplifier.

5. The impact responsive device of claim 3, further comprising a base station which includes:

the receiving device for receiving the conditioned sound signal transmitted by the mobile object;

an amplifier coupled to an output of the receiving device; and a speaker coupled to an output of the amplifier.

6. The impact responsive device of claim 3 including mode selection means, the mode selection means selecting a mode of operation of the mobile object in accordance with a sequence of impacts.

* * * * *